US010845117B2

(12) United States Patent
Scalf et al.

(10) Patent No.: US 10,845,117 B2
(45) Date of Patent: Nov. 24, 2020

(54) REFRIGERATOR WITH VARIABLE FLUID DISPENSER

(71) Applicant: Midea Group Co., Ltd., Foshan (CN)

(72) Inventors: Eric Scalf, Louisville, KY (US); Mark W. Wilson, Simpsonville, KY (US); Paul Staun, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 135 days.

(21) Appl. No.: 16/214,835

(22) Filed: Dec. 10, 2018

(65) Prior Publication Data

US 2020/0182533 A1 Jun. 11, 2020

(51) Int. Cl.

| | |
|---|---|
| ***F25C 5/10*** | (2006.01) |
| ***F25D 23/12*** | (2006.01) |
| ***F25C 5/20*** | (2018.01) |

(52) U.S. Cl.

CPC ..... *F25D 23/126* (2013.01); *F25C 5/22* (2018.01); *F25C 2600/04* (2013.01); *F25D 2323/121* (2013.01); *F25D 2323/122* (2013.01); *F25D 2400/361* (2013.01)

(58) Field of Classification Search

CPC ..... F25D 2323/121; F25D 2323/122; F25D 23/126; F25D 2400/361

See application file for complete search history.

(56) References Cited

U.S. PATENT DOCUMENTS

| | | | |
|---|---|---|---|
| 3,196,628 | A | 7/1965 | Reynolds |
| 3,824,805 | A | 7/1974 | Prada |
| 5,033,273 | A | 7/1991 | Buchser et al. |
| 5,273,219 | A | 12/1993 | Beach, Jr. et al. |
| 5,875,930 | A | 3/1999 | Nakajima et al. |
| 5,881,930 | A | 3/1999 | Lee |
| 6,607,096 | B2 | 8/2003 | Glass et al. |
| 7,210,601 | B2 | 5/2007 | Hortin et al. |
| 7,543,453 | B2 | 6/2009 | Boarman et al. |

(Continued)

FOREIGN PATENT DOCUMENTS

| | | | |
|---|---|---|---|
| CN | 1156225 | A | 8/1997 |
| CN | 1598451 | A | 3/2005 |

(Continued)

OTHER PUBLICATIONS

Chen et al.; Knob Switch, Feb. 8, 2017, eSpacenet, CN 205938087, description (Year: 2017).*

(Continued)

*Primary Examiner* — Filip Zec

(74) *Attorney, Agent, or Firm* — Middleton Reutlinger

(57) ABSTRACT

A variable fluid dispenser for a refrigerator utilizes a variable control suitable for varying the rate of fluid dispensing by the dispenser. In some instances, the variable control may include a rotary control actuator that varies the fluid dispensing rate of the variable dispenser, and in some instances, the variable control may include a variable control actuator movable between a range of positions that includes a home position at which the variable dispenser is deactivated. In such instances, movement of the variable control actuator away from the home position both activates the variable dispenser to dispense fluid and increases the fluid dispensing rate of the variable dispenser.

20 Claims, 7 Drawing Sheets

(56) References Cited

U.S. PATENT DOCUMENTS

| | | | | |
|---|---|---|---|---|
| 7,591,399 | B2 * | 9/2009 | Hortin | B67D 1/0009 222/129.1 |
| 8,322,384 | B2 | 12/2012 | Ashrafzadeh et al. | |
| 8,333,305 | B2 * | 12/2012 | Kim | F25C 5/22 222/504 |
| 9,057,556 | B2 | 6/2015 | Ashrafzadeh et al. | |
| 9,267,732 | B2 | 2/2016 | Kim | |
| 10,077,183 | B2 | 9/2018 | McMahan et al. | |
| 2003/0126714 | A1 * | 7/2003 | Lynn | A47L 13/20 15/257.1 |
| 2008/0121667 | A1 | 5/2008 | Park et al. | |
| 2008/0228318 | A1 | 9/2008 | Roo et al. | |
| 2013/0306447 | A1 | 11/2013 | Polak | |
| 2014/0124544 | A1 | 5/2014 | Licht et al. | |

FOREIGN PATENT DOCUMENTS

| | | | |
|---|---|---|---|
| CN | 1624406 | A | 6/2005 |
| CN | 1707206 | A | 12/2005 |
| CN | 101421572 | A | 4/2009 |
| CN | 101611280 | A | 12/2009 |
| CN | 101738045 | A | 6/2010 |
| CN | 101738046 | A | 6/2010 |
| CN | 102171524 | A | 8/2011 |
| CN | 104081138 | A | 10/2014 |
| CN | 205938087 | U | 2/2017 |
| CN | 107560261 | A | 1/2018 |
| CN | 108506520 | A | 9/2018 |
| EP | 2365264 | A2 | 9/2011 |
| EP | 2331895 | B1 | 1/2017 |
| KR | 20020006131 | A | 1/2002 |
| KR | 100820816 | B1 | 4/2008 |
| KR | 100889125 | B1 | 3/2009 |
| KR | 20150008763 | A | 1/2015 |

OTHER PUBLICATIONS

International Search Report and Written Opinion issued in Application No. PCT/CN2019/094348 dated Sep. 23, 2019.

International Search Report and Written Opinion issued in Application No. PCT/CN2019/094389 dated Sep. 27, 2019.

TDRFORCE, TDRFORCE Bottle Water Dispenser Pump System for Coffee Brewer Ice-Maker Refrigerator, www.Amazon.com, Retrieved on Oct. 24, 2018.

GE Appliances, Bottom Freezer Refrigerator, GE Appliances, Retrieved on Oct. 24, 2018.

Cornelius, Intrallex Ice Dispenser IU 300 Ice Only Operator's/Installation Manual, www.cornelius, Aug. 3, 2010.

Transmittal of Related Applications.

U.S. Patent and Trademark Office, Office Action issued in U.S. Appl. No. 16/214,830 dated Jul. 31, 2020.

* cited by examiner

REFRIGERATOR WITH VARIABLE FLUID DISPENSER

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Many residential refrigerators also include as a convenience feature an integrated dispenser for dispensing a fluid (e.g., water) and/or ice. In addition, some refrigerators incorporate a water tank or other fluid storage receptacle that may be fixed or removable, and positioned within a cooled compartment of the refrigerator to cool the contained fluid prior to dispensing or otherwise serving (e.g., in the case where the receptacle is removable).

In addition, some refrigerators include flow sensors such as flow meters to measure the volume of fluid dispensed, generally to display to the user the amount of fluid being dispensed into a container. Further, in some designs the measurement of the amount of dispensed water can be used to enable a user to select a desired amount of water and have the dispenser automatically shut off when that desired amount has been reached.

Control over ice and/or fluid dispensers has predominantly been implemented using switches often referred to as paddles that are disposed below a dispenser and that are actuated by pressing the container into which the ice and/or fluid is to be dispensed against the paddles. Selection of dispensing modes such as between cubed ice, crushed ice and/or water has generally been performed using dedicated buttons on a control panel or through a touchscreen interface.

With the various options available for configuring a dispenser to dispense ice and/or fluid, however, configuration and actuation of a dispenser is not always intuitive to a user and can result in user frustration. A need still exists, therefore, for a more intuitive manner of controlling an ice and/or fluid dispenser.

SUMMARY

The herein-described embodiments address these and other problems associated with the art by providing in one aspect a variable fluid dispenser for a refrigerator that utilizes a variable control suitable for varying the rate of fluid dispensing by the dispenser. In some instances, the variable control may include a rotary control actuator that varies the fluid dispensing rate of the variable dispenser, and in some instances, the variable control may include a variable control actuator movable between a range of positions that includes a home position at which the variable dispenser is deactivated. In such instances, movement of the variable control actuator away from the home position both activates the variable dispenser to dispense fluid and increases the fluid dispensing rate of the variable dispenser.

Therefore, consistent with one aspect of the invention, a refrigerator may include a cabinet including one or more food storage compartments defined therein and one or more doors positioned to insulate the one or more food storage compartments from an exterior environment, a variable water dispenser coupled to the cabinet and configured to dispense water at a variable water dispensing rate from a dispenser outlet, and a variable control disposed on an exterior surface of a door among the one or more doors and coupled to the variable water dispenser. The variable control may include a rotary control actuator rotatable between a range of positions to vary the water dispensing rate of the variable water dispenser in response to rotation of the rotary control actuator, the range of positions including a home position at which the variable water dispenser is deactivated, and where rotation of the rotary control actuator away from the home position both activates the variable water dispenser to dispense water and increases the dispensing rate of the variable water dispenser, and a bias mechanism configured to bias the rotary control actuator to the home position, whereby the rotary control actuator returns to the home position when released by a user.

Consistent with another aspect of the invention, a refrigerator may include a cabinet including one or more food storage compartments defined therein and one or more doors positioned to insulate the one or more food storage compartments from an exterior environment, a variable dispenser coupled to the cabinet and configured to dispense a fluid at a variable fluid dispensing rate from a dispenser outlet, and a variable control disposed on an exterior surface of the cabinet and coupled to the variable dispenser, the variable control including a rotary control actuator configured to vary the fluid dispensing rate of the variable dispenser in response to rotation of the rotary control actuator.

In some embodiments, the exterior surface upon which the variable control is disposed is on a door of the cabinet. Also, in some embodiments, the rotary control actuator is rotatable about an axis of rotation that is generally perpendicular to the exterior surface of the cabinet. Further, in some embodiments, the variable control includes a stationary front surface, and the rotary control actuator includes a generally cylindrical wheel with at least a portion thereof disposed between the stationary front surface and the exterior surface of the cabinet.

In some embodiments, the rotary control actuator is configured to rotate about an axis of rotation, and the variable control further includes a secondary control responsive to an axial force applied to the variable control. In addition, in some embodiments, the secondary control includes a switch responsive to movement of the variable control along the axis of rotation. In some embodiments, the secondary control includes a touch-sensitive region of a surface of the variable control.

In addition, in some embodiments, the variable dispenser is configured to change a dispense mode in response to actuation of the secondary control. Moreover, in some embodiments, the variable dispenser is further configured to dispense ice, and the variable dispenser is configured to switch between a fluid dispensing mode and an ice dispensing mode in response to actuation of the secondary control. In some embodiments, the variable dispenser is configured to activate a fluid dispensing valve of the variable dispenser to dispense fluid in response to actuation of the secondary control, and the variable control controls the fluid dispensing rate of the variable dispenser when the secondary control is activated.

Moreover, in some embodiments, the variable control further includes a bias mechanism that biases the rotary control actuator to a home position, whereby the rotary control actuator returns to the home position when released by a user. Some embodiments may also include a dispenser actuation control configured to activate a fluid dispensing valve of the variable dispenser to dispense fluid in response to actuation of the dispenser actuation control, where the variable control controls the fluid dispensing rate of the variable dispenser when the dispenser actuation control is activated. In some embodiments, the dispenser actuation control includes a container-activated control positioned below the dispenser outlet of the variable dispenser and configured to be activated by a container placed below an outlet of the variable dispenser.

In addition, in some embodiments, the variable dispenser includes a water dispenser configured to dispense water from a dispenser outlet. In some embodiments, the variable dispenser includes a vented water storage receptacle upstream of the dispenser outlet and configured to dispense water at a higher rate than a water supply rate from a water supply in upstream communication with the vented water storage receptacle.

Consistent with another aspect of the invention, a refrigerator may include a cabinet including one or more food storage compartments defined therein and one or more doors positioned to insulate the one or more food storage compartments from an exterior environment, a variable dispenser coupled to the cabinet and configured to dispense a fluid at a variable fluid dispensing rate from a dispenser outlet, and a variable control disposed on an exterior surface of the cabinet and coupled to the variable dispenser, the variable control including a variable control actuator disposed above the dispenser outlet and configured to vary the fluid dispensing rate of the variable dispenser in response to movement of the variable control actuator, the variable control actuator movable between a range of positions, the range of positions including a home position at which the variable dispenser is deactivated, and where movement of the variable control actuator away from the home position both activates the variable dispenser to dispense fluid and increases the fluid dispensing rate of the variable dispenser.

Moreover, in some embodiments, the variable control actuator includes a rotary control actuator that is rotatable about an axis of rotation. Also, in some embodiments, the variable control actuator includes a linear control actuator that is moveable along a generally linear axis. In some embodiments, the variable control further includes a bias mechanism that biases the variable control actuator to the home position, whereby the variable control actuator returns to the home position when released by a user.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
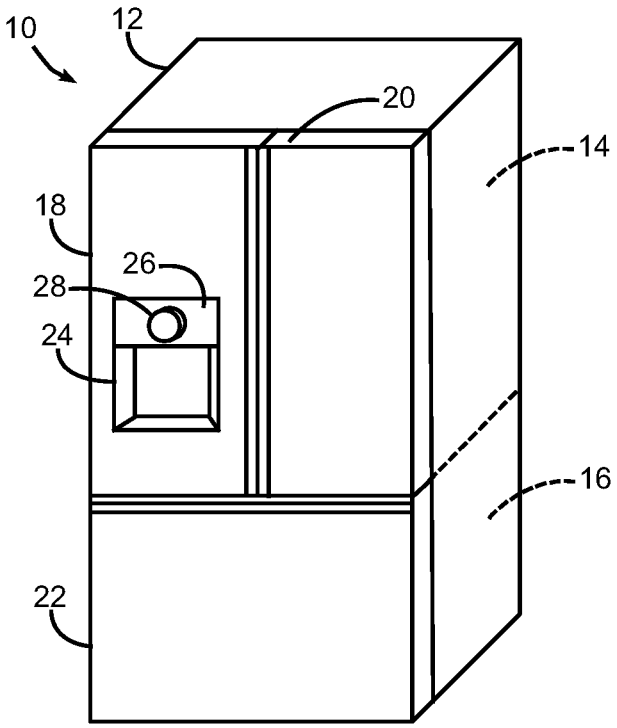
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a single sliding freezer compartment door 22 that is similar to a drawer and that pulls out to provide access to items in the freezer compartment. It will be appreciated, however, that other door designs may be used in other embodiments, including various combinations and numbers of hinged and/or sliding doors for each of the fresh food and freezer compartments. Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments.

Refrigerator 10 also includes a door-mounted dispenser 24 for dispensing ice and/or a fluid such as water. In the illustrated embodiments, dispenser 24 is an ice and water dispenser capable of dispensing both ice (cubed and/or crushed) and chilled water, while in other embodiments, dispenser 24 may be an ice only dispenser for dispensing only cubed and/or crushed ice. In still other embodiments, dispenser 24 may dispense hot water, coffee, beverages, or other fluids, and may have variable and/or fast dispense capabilities, as well as an ability to dispense predetermined or measured quantities of fluids. In some instances, ice and water may be dispensed from the same location, while in other instances separate locations may be provided in the dispenser for dispensing ice and water.

Refrigerator 10 also includes a control panel 26, which in the illustrated embodiment is integrated with dispenser 24 on door 18, and which includes various input/output controls such as buttons, indicator lights, alphanumeric displays, dot matrix displays, touch-sensitive displays, etc. for interacting with a user. In other embodiments, control panel 26 may be separate from dispenser 24 (e.g., on a different door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Furthermore, as will be discussed in greater detail below, control panel 26 may additionally include one or more variable controls, e.g. a variable control 28, for use in controlling dispenser 24, in particular to vary the dispensing rate of ice and/or fluids from the dispenser in an intuitive and efficient manner. Variable control 28 may be disposed on an exterior surface of cabinet 12, e.g., on a door 18, 20, 22 or a fixed exterior surface elsewhere on the cabinet.

Figure 2:
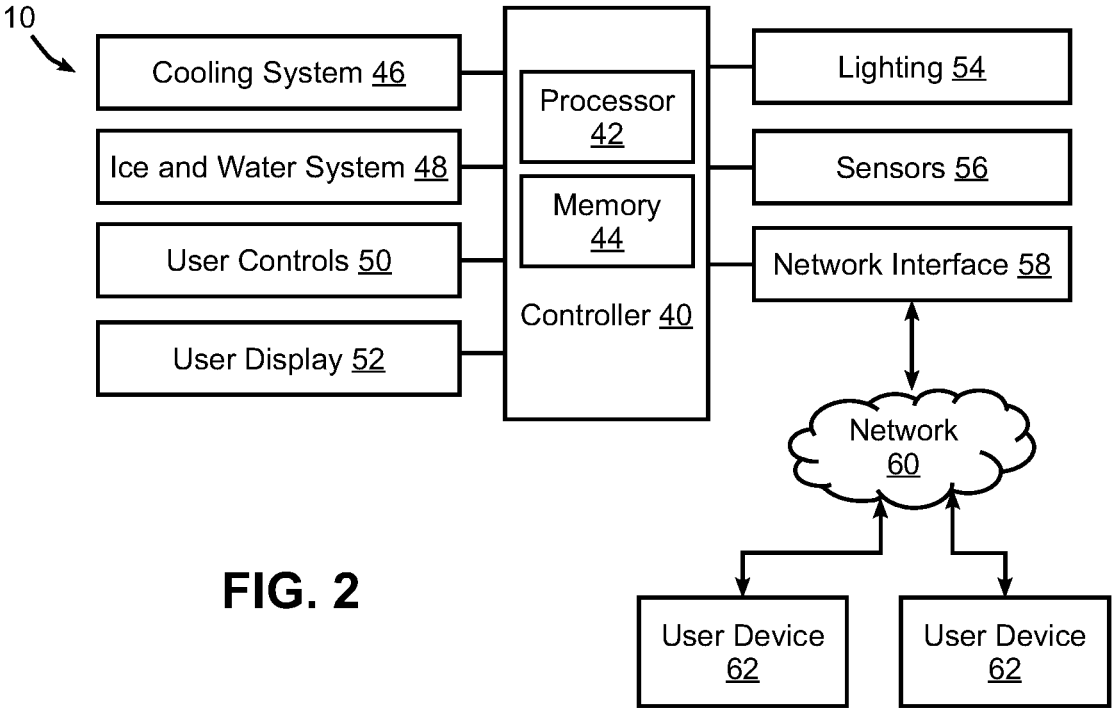
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40. Controller 40 may also be distributed among multiple controller circuits within refrigerator 12 in some embodiments, so the invention should not be considered to be limited to a controller implemented as a single central controller circuit as is illustrated in FIG. 2.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc., as well as one or more variable controls as discussed in greater detail below), and one or more user displays 52 (including various indicators, graphical displays, textual displays, speakers, etc.), as well as various additional components suitable for use in a refrigerator, e.g., interior and/or exterior lighting 54, among others.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Figure 3:
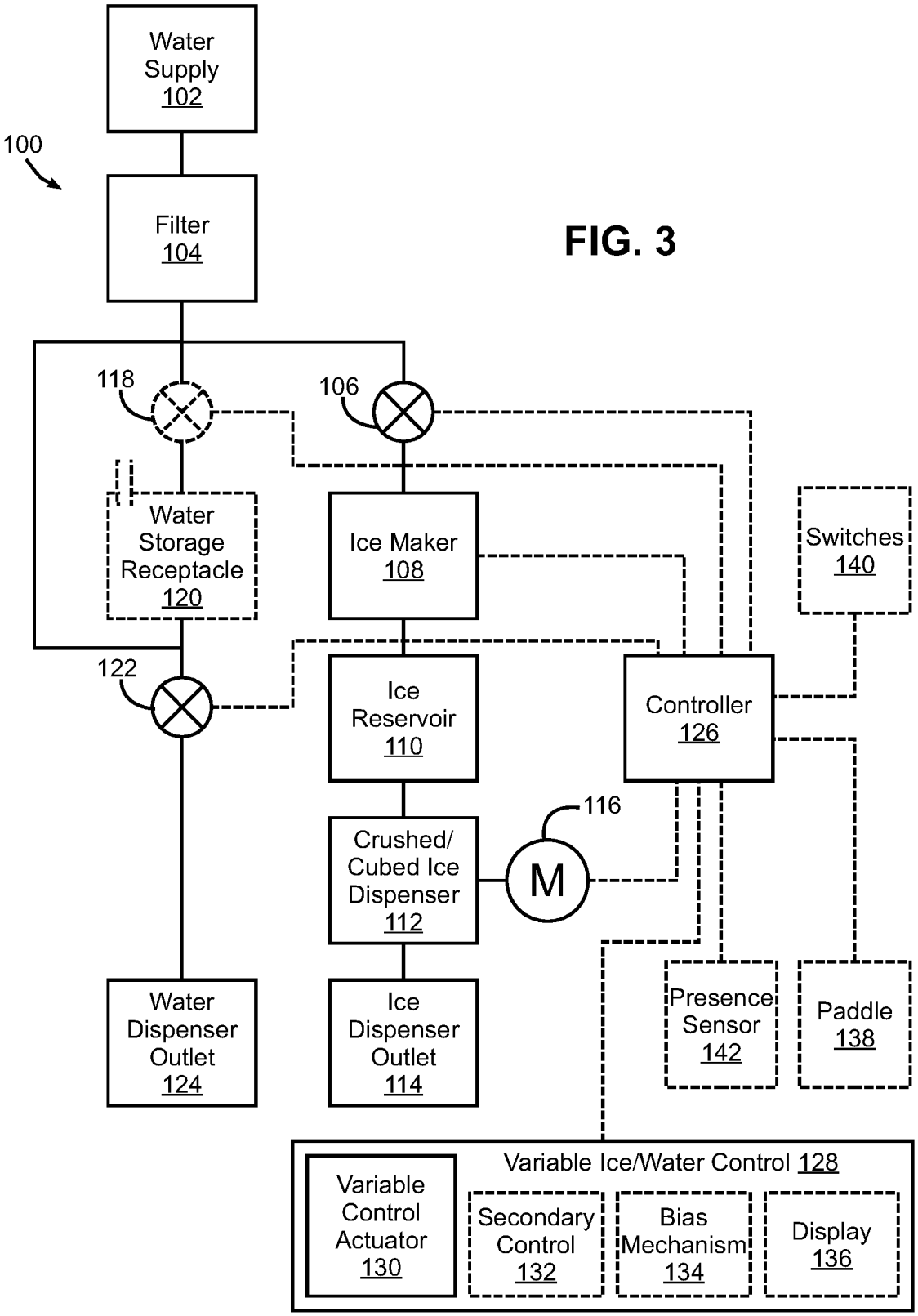
FIG. 3 is a block diagram of a combined ice and water system suitable for use in the refrigerator of FIGS. 1-2.

Now turning to FIG. 3, embodiments consistent with the invention, as mentioned above, are directed in part to the use of an ice and/or water dispenser incorporating one or more variable controls for varying the dispensing rate of ice, water and/or another fluid dispensed by the dispenser. FIG. 3, in particular, illustrates an ice and water system 100 for dispensing both ice and cooled water. It will be appreciated, however, that the principles of the invention may be utilized in connection with other systems, including systems that dispense ice only, systems that dispense cooled water only, or dispensers that dispense, in lieu of or in addition to ice and/or cooled water, other fluids such as hot water, coffee, beverages, etc. Therefore, the invention is not limited to the particular ice and water system illustrated in FIG. 3.

Water from a water supply 102 (e.g., a residential water source) may be provided to a filter 104 that filters the incoming water. For the purposes of producing and dispensing ice, filter 104 outputs to an ice maker valve 106 that feeds an ice maker 108, which outputs ice to an ice reservoir 110 in a manner that will be appreciated by those of ordinary skill having the benefit of the instant disclosure. When it is desired to dispense ice to a user, an ice dispenser 112 is actuated to dispense ice from ice reservoir 110 to an ice dispenser outlet 114. As will become more apparent below, in the illustrated embodiment dispenser 112 is capable of dispensing both cubed (uncrushed) and crushed ice, e.g., using various techniques that will be apparent to those of ordinary skill having the benefit of the instant disclosure, such as rotating an auger in one direction to dispense cubed ice and rotating the auger in an opposite direction that actuates an ice crusher to crush the cubed ice prior to dispensing. In addition, in the illustrated embodiment, ice dispenser 112 is driven by a variable speed electric dispensing motor 116 capable of varying the dispensing rate of the ice dispenser, e.g., to vary the rotational speed of an auger in dispenser 112.

For the purposes of dispensing water, filter 104 also outputs to a receptacle fill valve 118 that fills a water storage receptacle 120 to maintain a quantity of water in the receptacle to enable the water to be cooled prior to dispensing. The receptacle outputs to a water dispensing valve 122 to dispense water out of a water dispenser outlet 124, and in the illustrated embodiment, valve 122 is a variable valve capable of varying the dispensing rate of the water dispenser. In some embodiments, receptacle 120 may be vented, which may enable water to be dispensed at a higher rate than a water supply rate from water supply 102, while in other embodiments, receptacle 120 may not be vented. Further, in some embodiments, receptacle 120 may be removable, while in still other embodiments no receptacle may be used, whereby receptacle 120 and fill valve 118 may be omitted.

Control over ice and water system 100 may be provided by a controller 126, which may be separate from, or integrated into, the main controller of the refrigerator. Controller 126 may control, among other components, ice maker valve 106, ice maker 108, variable speed electric motor 116, fill valve 118 and variable water dispensing valve 122.

In addition, controller 126 may be coupled to a variable ice/water control 128 including one or more variable control actuators 130, e.g., one or more knobs, sliders, wheels, dials, potentiometers, button or switch arrays, etc. capable of selecting from among a plurality of values within a range of values. In some embodiments, a variable control may output values within a continuous range of values, e.g., as is the case with a potentiometer, while in other embodiments, a variable control may output values in a range of discrete values, e.g., as is the case with an array of buttons or switches. Moreover, a variable control actuator in some embodiments may include a single control (e.g., as in the case of a knob, wheel, dial or slider), while in other embodiments a variable control actuator may include multiple controls (e.g., as in the case of multiple buttons or switches, or in the case of a touchscreen or other touch-sensitive surface having multiple actuatable regions). As such, other types of controls that output multiple values within a range of values may be used for a variable control in other embodiments. Moreover, the signals output by a variable control may differ in various embodiments, e.g., to represent values within a range of values using various signal characteristics such as voltage, current, pulse width, frequency, etc.

In this regard, a variable control actuator in some embodiments may be movable (e.g., in the case of a linear control actuator such as a slider that moves along a generally linear axis or a linear arrangement of buttons or regions in a touch-sensitive surface) within a range of positions. In some embodiments, such movement may be rotation about an axis of rotation, e.g., in the case of a rotary control actuator such as a knob or wheel. Further, in some embodiments, the range of positions may include a home position, which in some embodiments may also function as an "off" position at which the dispenser is deactivated and does not dispense any fluid or ice (although in other embodiments the home position may represent a minimum dispensing rate). Movement of a variable control actuator away from the home position may increase a dispensing rate of the dispenser, e.g., such that the dispensing rate is greater the farther away the variable control actuator is from the home position, and as noted above, may also in some embodiments automatically activate the dispenser to begin dispensing fluid or ice. In addition, as will become more apparent below, in some embodiments a home position may be proximate a center of the range of positions, and movement of a control actuator in different directions from a home position may vary a mode of the dispenser, e.g., to dispense cubed ice vs. crushed ice, to dispense ice vs. water or another fluid, or to dispense different types of fluids.

In addition, in some embodiments a variable ice/water control 128 may include additional components. For example, in some embodiments control 128 may include a secondary control 132, e.g., one or more switches, or a touch-sensitive surface. In one embodiment, for example, where variable control actuator 130 is a knob, pressing the knob on its face may induce an axial force that actuates a momentary switch to signal a user action, e.g., to change a mode or setting, or to actuate a dispenser, similar to a "click" gesture on a computer. Alternatively, if variable control 128 includes a touch-sensitive surface, touching or pressing on a face of the variable control may actuate the secondary control. In either instance, it will be appreciated that an axial force (i.e., a force generally in the direction of the axis of rotation of a rotary control actuator) actuates the secondary control. It will be appreciated, however, that a secondary control may be actuated in other manners, e.g., by depressing a slider on a linear control actuator.

In addition, in some embodiments, variable ice/water control 128 may include a bias mechanism 134. In particular, in some embodiments, it may be desirable to bias variable control actuator 130 to a predetermined position, e.g., a predetermined rotational position for a knob or a predetermined linear position for a slider, such that when the variable control is released by a user, the variable control returns to the predetermined position. Various types of spring and other biasing arrangements, e.g., leaf springs, clock springs, coiled springs, torsion springs, elastic materials, etc., may be used to bias a variable control to a predetermined position in different embodiments, as will be appreciated by those of ordinary skill having the benefit of the instant disclosure.

Furthermore, in some embodiments, variable ice/water control 128 may also include a display 136, e.g., one or more lights, icons, alphanumeric indicators, etc., a touchscreen, or another suitable display capable of providing feedback to a user. Furthermore, audio, haptic and/or video feedback may also be provided to a user interacting with control 128 in other embodiments, as will be appreciated by those of ordinary skill having the benefit of the instant disclosure.

In some embodiments, variable ice/water control 128 may be the sole mechanism through which a user controls ice and water system 100. In other embodiments, however, additional controls, sensors and/or user interfaces may be incorporated into an ice and water system and interfaced with controller 126. For example, in some embodiments one or more container-actuated controls, e.g., paddles 138, e.g., as have been used in traditional ice and water dispensers and implemented using either buttons or levers that are actuated when a container such as a glass or cup is placed under a dispenser outlet, may be used. It will be appreciated that a container-actuated control may also be actuated in other manners (e.g., via the fingers or hands), but is container-actuated insofar as the control is positioned such that actuation by a container positions the container below a dispenser outlet to received dispensed ice or fluid.

In addition, in some embodiments one or more switches 140, which may include various types of buttons, toggles, etc., may also be interfaced with controller 126, e.g., to configure a mode or other setting for the ice and water system, to actuate ice and water dispenser, or for other purposes that will be appreciated by those of ordinary skill having the benefit of the instant disclosure.

Moreover, in some embodiments, a presence sensor 142, e.g., an ultrasonic sensor, may be interfaced with controller 126 to detect the presence of a container below a dispenser outlet. Presence sensor 142 may be used, for example, to automatically start and stop dispensing based upon the presence of a container, or otherwise to prevent dispensing when no container is detected below a dispenser outlet.

Each of secondary control 132, paddle 138, a switch 140 and presence sensor 142 may, in some embodiments, function as a dispenser actuation control to activate a variable dispenser, e.g., to activate fluid dispensing valve 122 to dispense fluid, or to activate auger motor 116 to dispense ice. Moreover, as noted above, in some embodiments activation of a variable dispenser may be performed through movement of variable control actuator 130 away from a home position.

It will be appreciated that other controls, displays, etc., may also be utilized in an ice and water system in other embodiments. For example, a touchscreen interface may be used in some embodiments for user interaction and control. In addition, in some embodiments, control and/or configuration of a dispenser may be performed using a remote device, e.g., via an app on a mobile device. In some embodiments, for example, default dispensing rates and/or other settings may be selected through an app. Further, in some embodiments, default dispensing rates and/or other settings may be selected through an refrigerator-mounted control panel, e.g., via a touchscreen interface. In addition, in embodiments where a variable control includes an electronically controllable variable control actuator (e.g., an electronically movable rotary or linear control actuator), default dispensing rates (e.g., based on stored settings or a setting used for a last dispense operation) may be established at the onset of dispensing through controlled movement of the variable control actuator to a default position. Other modifications will be apparent to those of ordinary skill having the benefit of the instant disclosure, and as such, the invention is not limited to the particular configuration of ice and water system 100 of FIG. 3.

Figure 4:
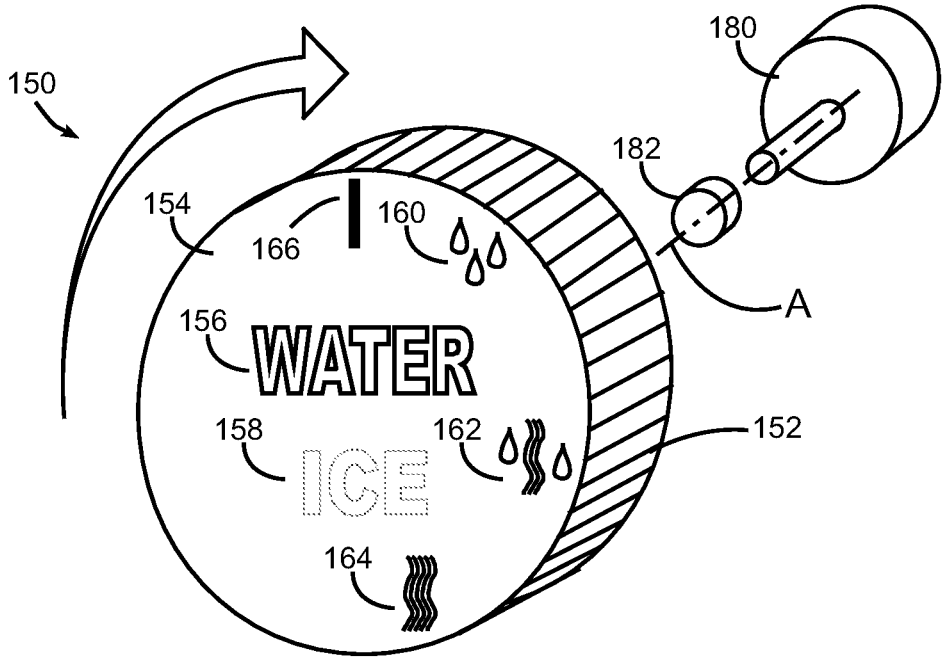
FIG. 4 is a perspective view of an example implementation of a variable ice/water control suitable for use in the refrigerator of FIGS. 1-2, shown in a water dispensing mode.
Figure 5:
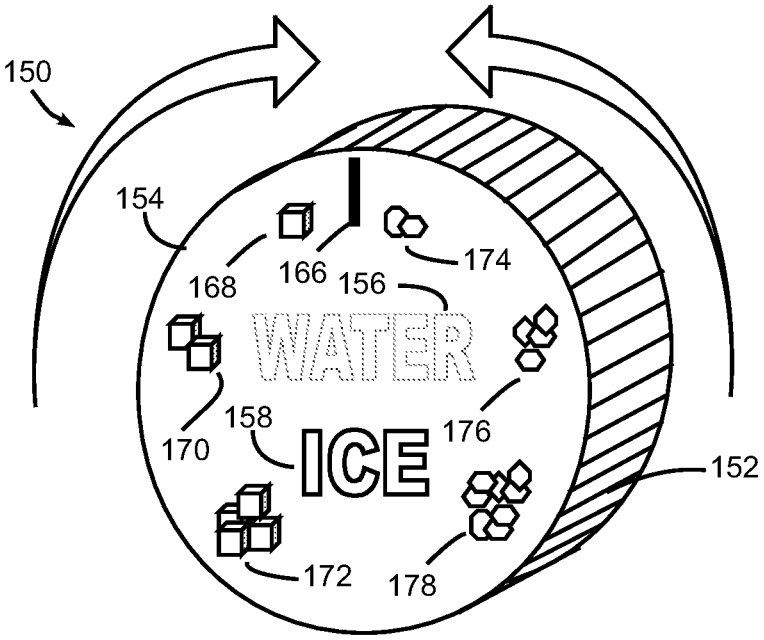
FIG. 5 is a perspective view of the variable ice/water control of FIG. 4, shown in an ice dispensing mode.

Now turning to FIGS. 4-5, these figures illustrate one example of a variable ice/water control 150 suitable for use as variable control 28 in refrigerator 10. In this implementation, variable control 150 is implemented with a rotary control actuator 152, here a knob or wheel, that is rotatable about an axis of rotation A, which is generally perpendicular to an exterior surface of the refrigerator (e.g., the exterior surface of door 18). In other embodiments, rotary control actuator 152 may rotate about an axis that is generally parallel to an exterior surface, and may also be partially recessed within the cabinet, e.g., similar to a thumbwheel.

While in some embodiments rotary control actuator 152 may include a front face that rotates with the actuator, in FIGS. 4-5, actuator 152 is configured as a generally cylindrical wheel with at least a portion thereof disposed between a stationary front surface 154 and the exterior surface of refrigerator, such that stationary front surface 154 may provide a user display, e.g., a collection of individual lighted indicators or a dot matrix display.

For example, a pair of mode indicators 156, 158 may be used to indicate whether the ice and water system is in a water dispensing mode or an ice dispensing mode. FIG. 4, for example, illustrates a water dispensing mode where indicator 156 is illuminated with the text "water" and indicator 158 dimmed or hidden, while FIG. 5 illustrates an ice dispensing mode where indicator 156 is dimmed or hidden and indicator 158 is illuminated with the text "ice."

In the water dispensing mode (FIG. 4), one or more additional indicators 160, 162, 164 may be illuminated to illustrate low, medium and high water dispensing rates, thereby indicating to the user that rotation of rotary control actuator 152 in a clockwise direction will progressively increase the water dispensing rate of the ice and water system. Moreover, a home position indicator 166 may be illuminated to represent the home position. Likewise, in the ice dispensing mode (FIG. 5), indicators 160-164 may be dimmed or hidden, and one or more additional indicators 168, 170, 172 may be illuminated to illustrate low, medium and high cubed ice dispensing rates (thereby indicating to the user that rotation of rotary control actuator 152 in a counter-clockwise direction will progressively increase the ice dispensing rate when dispensing cubed ice), while one or more additional indicators 174, 176, 178 may be illuminated to illustrate low, medium and high crushed ice dispensing rates (thereby indicating to the user that rotation of rotary control actuator 152 in a clockwise direction will progressively increase the ice dispensing rate when dispensing crushed ice). It will be appreciated that any of indicator groups 160-164, 168-172 and 174-178 may all be active in the appropriate dispensing mode in some embodiments, while in other embodiments, the individual indicators in each group may be progressively illuminated as the dispense rate increases.

Variable control 150 also includes a rotation sensor 180, e.g., an encoder, potentiometer, or other sensor capable of sensing rotation of rotary control actuator 152, as well as a secondary control 182, e.g., a mechanical switch that is actuated in response to axial movement along axis of rotation A. In the alternative, stationary front surface 154 may include a button, or may include a touch-sensitive region that actuates the secondary control when touched.

Variable control 150 also includes a bias mechanism, e.g., a clock spring, that biases rotary control actuator 152 to the home position. In some embodiments, one or more stops may be used to constrain rotation of actuator 152 within a range that extends a predetermined number of degrees in each direction from the home position, and in some embodiments, detents may be used to resist rotation of the actuator from the home position, thereby providing feedback to the user at the start of a dispensing operation.

In operation, dispensing of water, cubed ice and crushed ice may be controlled by a user solely through interaction with variable control 150. To select between water and ice dispensing modes, a user may depress variable control 150, e.g., by pressing on stationary front surface 154, thereby actuating secondary control 182. The active mode is indicated using indicators 156, 158.

When in the water dispensing mode (FIG. 4), indicators 160-164 are used as a guide, and rotating rotary control actuator 152 clockwise from the home position both activates the ice and water system to dispense water (e.g., by activating a variable water valve) and controls the water dispensing rate, with further clockwise rotation increasing the water dispensing rate.

When in the ice dispensing mode (FIG. 5), indicators 168-178 are used as a guide, and rotating rotary control actuator 152 counter-clockwise from the home position both activates the ice and water system to dispense cubed ice (e.g., by activating an auger motor, but with an ice crusher deactivated) and controls the ice dispensing rate, with further counter-clockwise rotation increasing the speed of the auger motor, and thus the ice dispensing rate. Similarly, rotating rotary control actuator 152 clockwise from the home position both activates the ice and water system to dispense crushed ice (e.g., by activating an auger motor with an ice crusher activated) and controls the ice dispensing rate, with further clockwise rotation increasing the speed of the auger motor, and thus the ice dispensing rate.

In either mode, due to the bias mechanism, releasing the rotary control actuator 152 will return the actuator to the home position, thereby deactivating the dispenser. Thus, a user can dispense cubed ice, crushed ice, or water, and do so at a variable rate, solely through interaction with variable control 150. In other embodiments, however, an additional dispenser actuation control may be used to activate and/or deactivate a dispenser, e.g., the use of a separate button, switch, container-actuated control and/or presence sensor.

Figure 6:
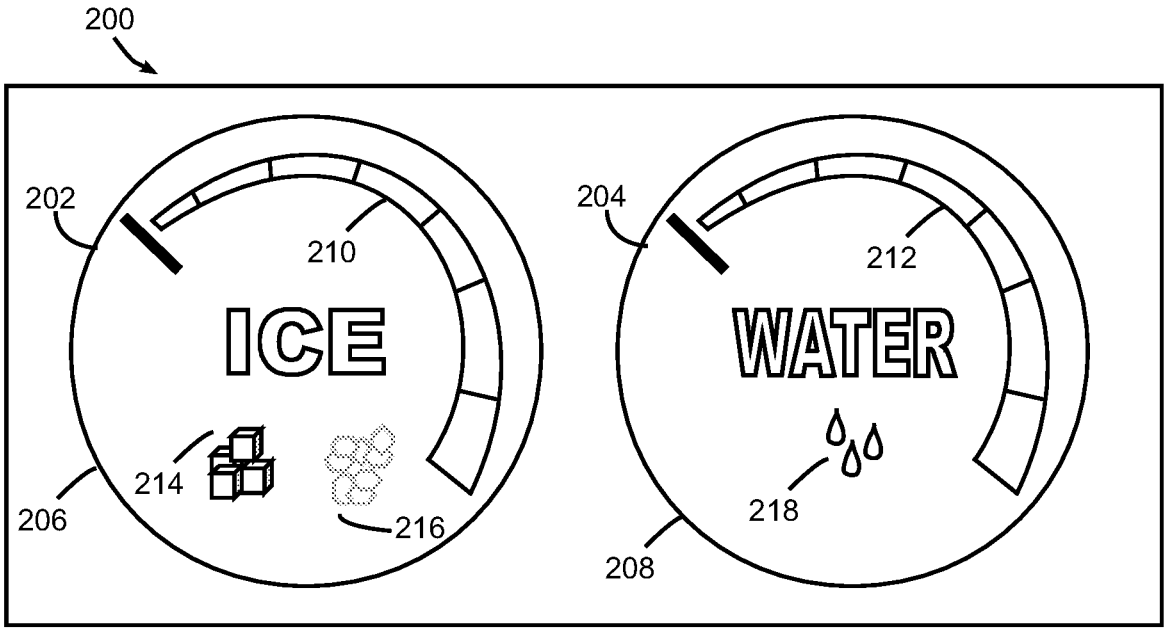
FIG. 6 is a front elevational view of an example implementation of separate variable ice and variable water controls suitable for use in the refrigerator of FIGS. 1-2.

A wide variety of alternate designs may be used for a variable control in other embodiments. FIG. 6, for example, illustrates an alternate design in which a control panel 200 includes separate variable ice and variable water controls 202, 204 suitable for dispensing ice and water. Each variable control 202, 204 is similarly configured to variable control 150, with a respective rotary control actuator 206, 208 disposed behind a stationary front face providing a user display to provide feedback to a user interacting with each variable control. Each variable control 202, 204 includes a respective segmented display 210, 212 that progressively illuminates different segments based upon the degree to which the associated rotary control actuator 206, 208 is rotated in a clockwise direction from the home position, thereby graphically representing the dispense rate associated with a rotational position of the rotary control actuator. In addition, variable ice control 202 may include cubed and crushed indicators 214, 216, which may be selectively illuminated based upon whether the ice dispenser is in a cubed or crushed mode. Selection of the mode may be performed, for example, by depressing variable ice control 202, in a similar manner to the ice/water mode selection for variable control 150 of FIGS. 4-5. In addition, a similar water indicator 218 may be illuminated on variable water control 204, although no separate indicator may be used for the variable water control. Alternatively, if multiple fluids are supported (e.g., hot vs. cold water, water or a beverage, etc.), a similar mode selection may be utilized for variable water control 204 as is used for variable ice control 202.

In addition, in the embodiment illustrated in FIG. 6, a bias mechanism is used to return each variable control 202, 204, and a home position for each control deactivates the associated dispenser, such that movement away from the home position both activates the associated dispenser and controls the dispense rate thereof. In other embodiments, however, an additional dispenser actuation control may be used to activate and/or deactivate a dispenser, e.g., the use of a separate button, switch, container-actuated control and/or presence sensor.

It will be appreciated that each of variable controls 202, 204 may be utilized separate from one another in other embodiments, e.g., where only an ice dispenser or only a water dispenser is provided, or where one of an ice and water dispenser is controlled via conventional controls, and the other is controlled using the appropriate variable control 202, 204.

Figure 7:
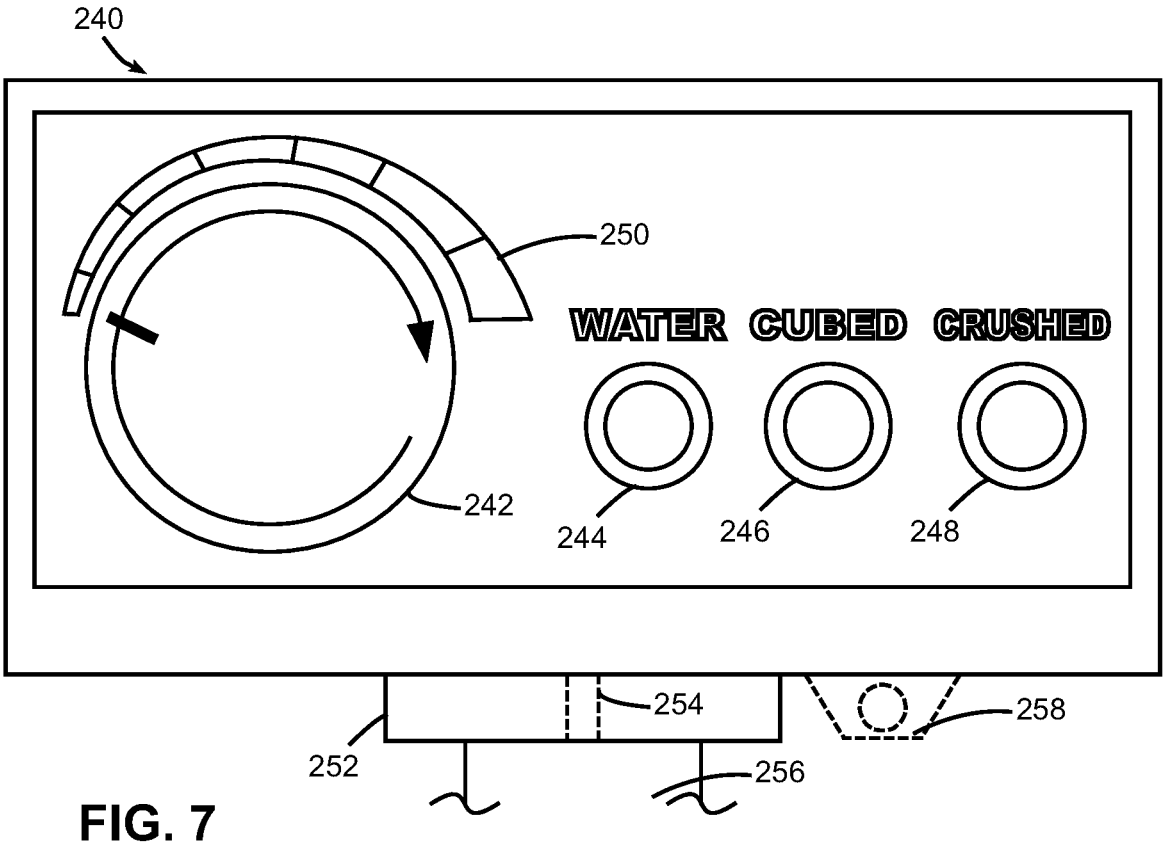
FIG. 7 is a front elevational view of an example implementation of a combined ice/water dispenser including a variable control suitable for use in the refrigerator of FIGS. 1-2, with the variable control implemented as a rotary knob.

FIG. 7 illustrates another example embodiment of a control panel 240 including a variable control 242 coupled with three mode selection switches 244, 246, 248, respectively used to select water, cubed ice and crushed ice dispensing modes. In this embodiment, variable control 242 is implemented using a knob or other rotary control actuator, but with a front face that rotates with the actuator. A segmented graph 250 is disposed on the control panel, rather than on the variable control, to graphically indicate the dispensing rate associated with each rotational position of the actuator. In some embodiments, the segmented graph 250 may have lighted segments that are illuminated in response to the position of variable control 242, although in other embodiments the graph may be static, and may even in some embodiments be implemented using non-illuminated graphics.

Each mode selection switch 244, 246, 248 may be used to select a dispensing mode, and each may be implemented using a toggle or maintained switch in some embodiments or using a momentary switch in other embodiments. Control panel 240, and thus, variable control 242, is disposed above both an ice dispenser outlet 252 and a water dispenser outlet 254, and in some embodiments, activation of a dispenser may be implemented via rotation of variable control 242 away from a home position. In other embodiments, however, activation of a dispenser may be made by depressing and holding down an associated mode selection switch 244, 246, 248. In still other embodiments, a container-actuated control such as paddle 256 may be used to activate a dispenser, and in other embodiments, a presence sensor 258 (e.g., an ultrasonic sensor), may be used to automatically activate a dispenser upon detecting a container beneath a dispenser outlet. In still other embodiments, presence sensor 258 may be used in connection with a different dispenser actuation control to inhibit activation of a dispenser when no container is detected.

Variable control 242 in the illustrated embodiment does not include a bias mechanism, and the control may maintain its position after dispensing is complete, thereby allowing a user to dispense without having to hold variable control 242 once the control has been rotated to its desired position. In other embodiments, however, variable control 242 may include a bias mechanism and stops to constrain movement between a home position and a maximum dispensing rate position.

Figure 8:
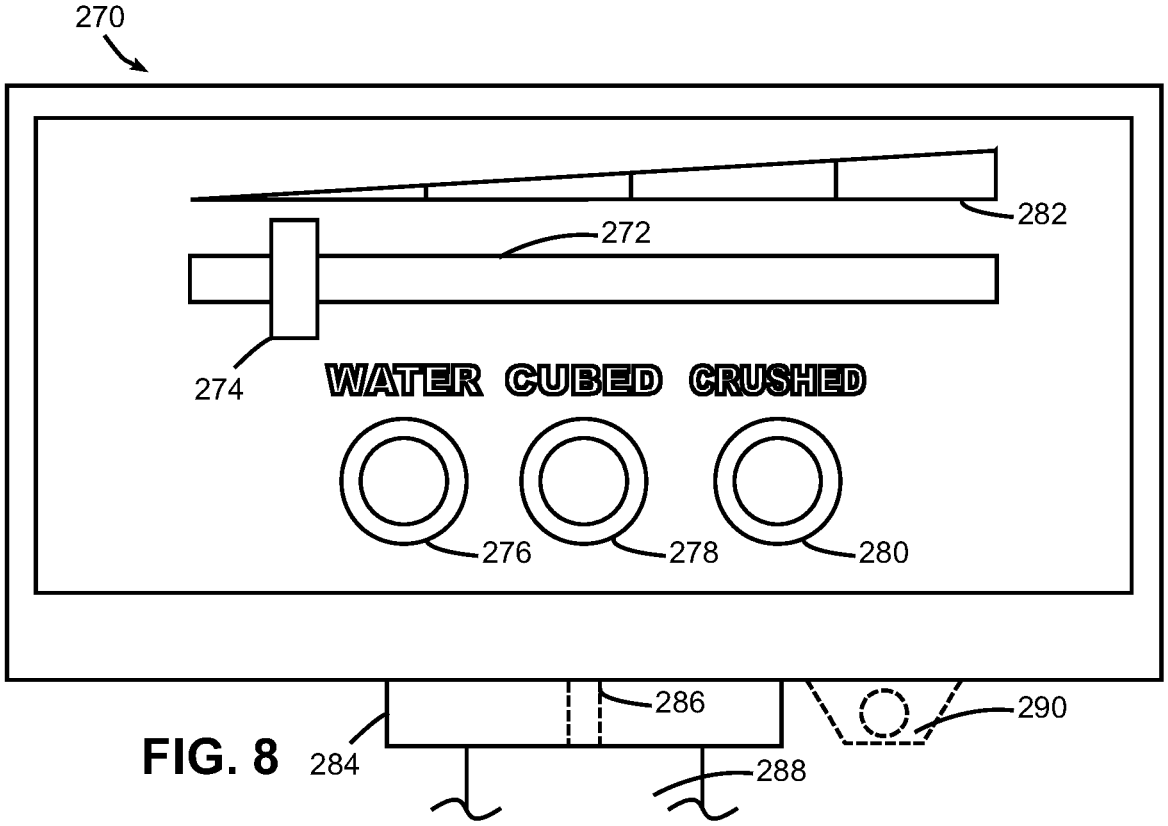
FIG. 8 is a front elevational view of another example implementation of a combined ice/water dispenser including a variable control suitable for use in the refrigerator of FIGS. 1-2, with the variable control implemented as a slider.

FIG. 8 next illustrates another example embodiment of a control panel 270, which is similar to control panel 240 of FIG. 7, but replaces the rotary variable control with a linear variable control 272 including a linear control actuator 274, e.g., a slider lever. A similar set of water, cubed ice and crushed ice mode selection switches 276, 278, 280 are provided, as is a segmented graph 282. Control panel 270 is disposed above ice and water dispenser outlets 284, 286, and one or both of a paddle 288 and presence sensor 290 may optionally be provided as well. Linear control actuator 274 may include a bias mechanism in some embodiments such that the actuator returns to a home position when released, while in other embodiments, the bias mechanism may be omitted, thereby permitting the dispensing rate selected for a given dispensing operation to be used for subsequent dispensing operations if not moved. In addition, while in some embodiments, movement of actuator 274 away from the home position may activate the dispenser associated with the current mode, in other embodiments dispenser activation may be initiated via selection of one of switches 276-280, via a separate dispense switch, via a container-actuated switch such as paddle 288 or via presence sensor 290.

Figure 9:
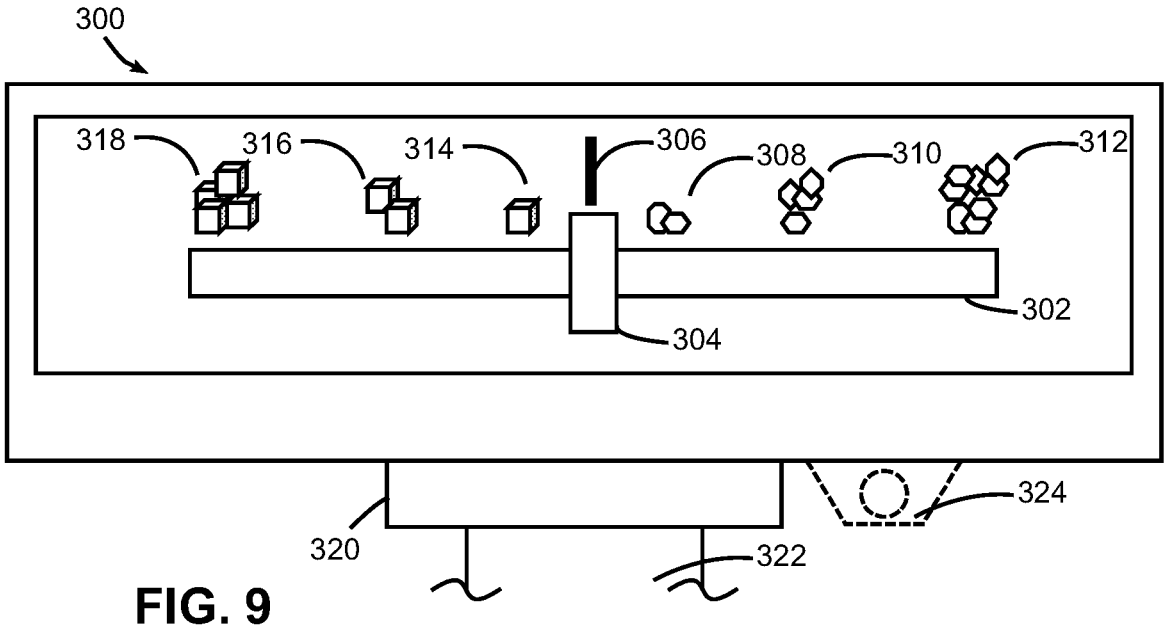
FIG. 9 is a front elevational view of an example implementation of an ice dispenser including a variable control suitable for use in the refrigerator of FIGS. 1-2, with the variable control implemented as a combined crushed ice/cubed ice slider.

FIG. 9 next illustrates an example control panel 300 for an ice dispenser, which includes a variable control 302 including a linear control actuator 304, e.g., a slider lever, that is movable in two directions from a central home position 306. Movement of actuator 304 to the right activates a crushed mode, with the dispensing rate of crushed ice varied based upon how far to the right actuator 304 is from home position 306, while movement of actuator 304 to the left activates a cubed mode, with the dispensing rate of cubed ice varied based upon how far to the left actuator 304 is from home position 306. Crushed indicators 308, 310, 312 are provided to indicate relative crushed ice dispensing rates, while cubed indicators 314, 316, 318 are provided to indicate relative cubed ice dispensing rates, and indicators 308-318 may be illuminated or non-illuminated in different embodiments, and in some embodiments, may be illuminated based upon the position of actuator 304.

Control panel 300 and variable control 302 are disposed above dispenser outlet 320, and while in some embodiments no bias mechanism may be used for variable control 302, in the illustrated embodiment, a bias mechanism may be provided such that the actuator returns to home position 306 when released. In addition, while in some embodiments, movement of actuator 304 away from the home position may activate the dispenser to dispense crushed or cubed ice (based upon the direction from the home position), in other embodiments dispenser activation may be initiated via selection of a separate dispense switch, via a container-actuated switch such as paddle 322 or via presence sensor 324.

Figure 10:
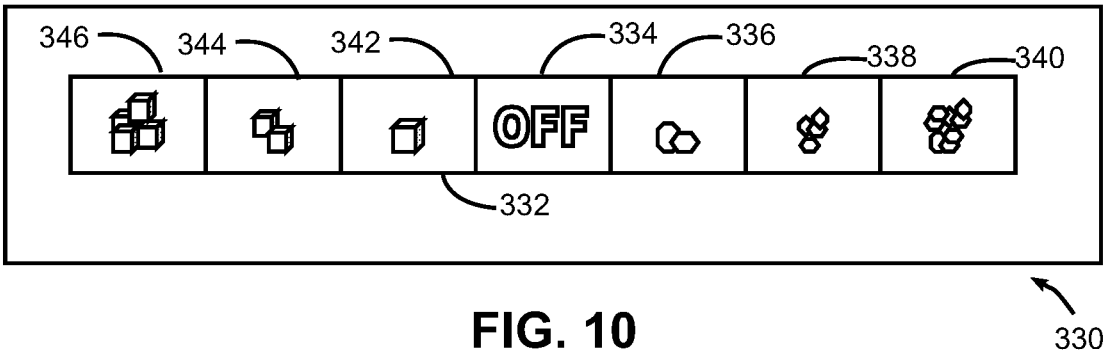
FIG. 10 is a front elevational view of another example implementation of a variable control suitable for use in the refrigerator of FIGS. 1-2, with the variable control implemented as a linear array of buttons or touch-sensitive regions.

FIG. 10 illustrates yet another example embodiment of a control panel 330, which is similar to control panel 300 of FIG. 9, but utilizes a different linear variable control 332, i.e., a linear array of toggle, maintained, or momentary buttons or switches, including an off button 334, three crushed ice buttons 336, 338, 340, and three cubed ice buttons 342, 344, 346. Alternatively, buttons 334-346 may be implemented as touch-sensitive regions of a touch-sensitive strip. Linear variable control 332 may function in a similar manner to variable control 302 of FIG. 9 to provide both crushed and cubed ice dispensing. In some embodiments, selection of one of buttons 336-346 may activate the dispenser to dispense crushed or cubed ice, with different dispensing rates associated with the different buttons, while in other embodiments dispenser activation may be initiated via selection of a separate dispense switch, via a container-actuated switch or via presence sensor 324.

Figure 11:
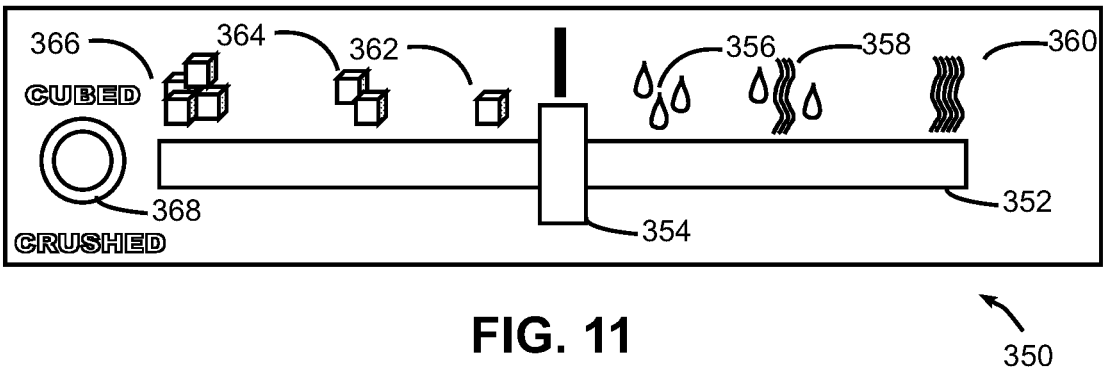
FIG. 11 is a front elevational view of an example implementation of a variable control suitable for use in the refrigerator of FIGS. 1-2, with the variable control implemented as a combined ice/water slider.

FIG. 11 illustrates another example embodiment of a control panel 350, which is similar to control panel 300 of FIG. 9, but utilizes a linear variable control 352 including a linear control actuator 354, e.g., a slider lever, that is movable in two directions from a central home position to dispense either water or ice. Movement of actuator 354 to the right activates a water mode, with the dispensing rate of water varied based upon how far to the right actuator 354 is from the home position, while movement of actuator 354 to the left activates an ice mode, with the dispensing rate of ice varied based upon how far to the left actuator 354 is from the home position. Water indicators 356, 358, 360 are provided to indicate relative water dispensing rates, while ice indicators 362, 364, 366 are provided to indicate relative ice dispensing rates, and indicators 356-366 may be illuminated or non-illuminated in different embodiments, and in some embodiments, may be illuminated based upon the position of actuator 354. A separate cubed/crushed mode selection switch 368 may also be provided to switch between cubed and crushed ice dispensing modes.

While in some embodiments no bias mechanism may be used for variable control 352, in the illustrated embodiment, a bias mechanism may be provided such that actuator 354 returns to the home position when released. In addition, while in some embodiments, movement of actuator 354 away from the home position may activate the dispenser to dispense water or ice (based upon the direction from the home position), in other embodiments dispenser activation may be initiated via selection of a separate dispense switch, via a container-actuated switch or via a presence sensor.

Figure 12:
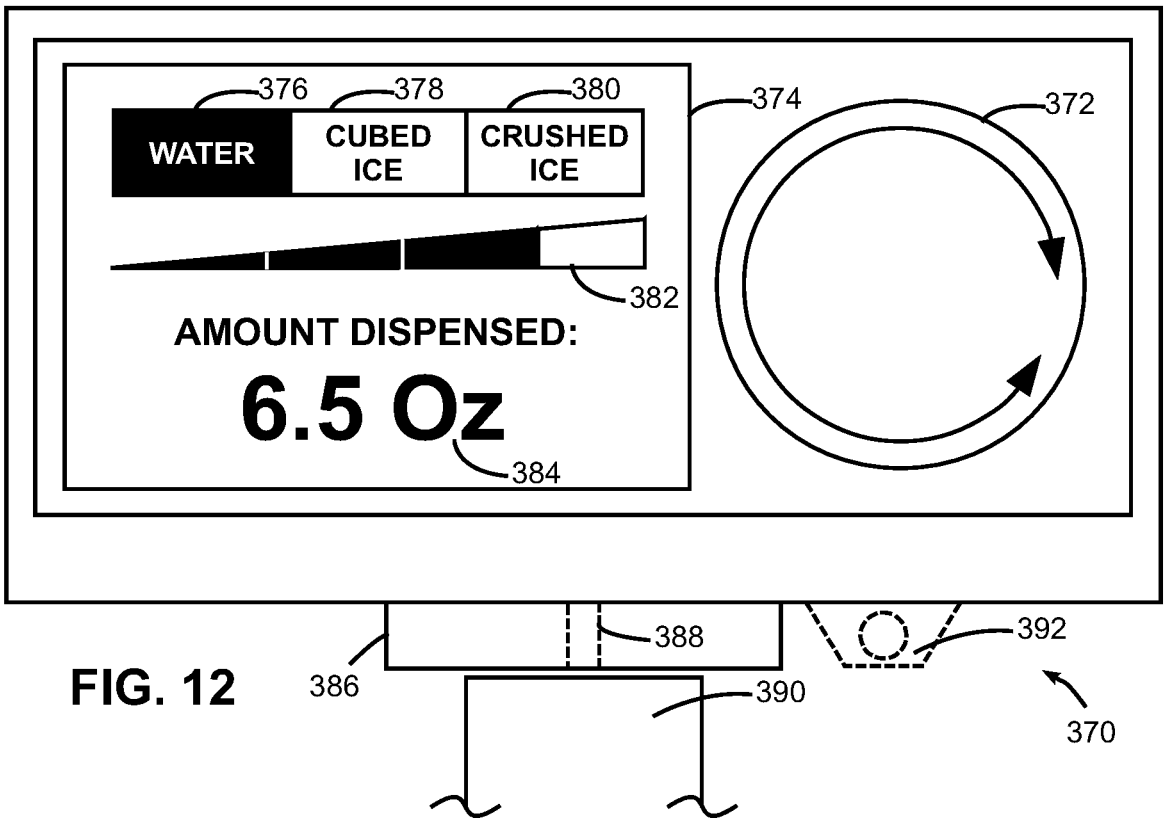
FIG. 12 is a front elevational view of another example implementation of a combined ice/water dispenser including a variable control suitable for use in the refrigerator of FIGS. 1-2, with the variable control implemented as a rotary knob and with additional controls implemented in a touchscreen display.

FIG. 12 next illustrates a touchscreen-based embodiment where a control panel 370 includes a variable control 372, e.g., a rotary variable control, coupled with a touchscreen display 374. Via the touchscreen display, any of the aforementioned control methodologies may be implemented, so the control methodology illustrated in the figure is non-limiting. In the illustrated implementation, for example, a set of water, cubed ice and crushed ice soft buttons 376, 378, 380 are utilized to select different dispensing modes, and a segmented graph 382 may be used to display a relative dispensing rate. In addition, the use of a touchscreen or other dot matrix display may enable additional advanced features to be implemented, e.g., displaying a total amount dispensed (illustrated at 384), or configuring the dispenser to display a predetermined quantity of ice or fluids. Control panel 370 is disposed above both ice and water dispenser outlets 386, 388, and as with other embodiments, variable control 372 may activate a dispenser based upon rotation away from a home position, while in other embodiments, dispenser activation may be performed via a secondary control (e.g., via depressing variable control 372), via a soft or hard button or other dispense switch, via a container-actuated switch such as paddle 390 or via a presence sensor 392.

In addition, variable control 372 may include a bias mechanism and a predetermined home position in some embodiments, while in other embodiments, no bias mechanism may be used. In addition, in some embodiments, no stops may be provided, such that unlimited rotation of variable control 372 is supported. Variable control 372 may also include a secondary control that is activated upon depression of the variable control, and in some instances, the variable control may also be used for other user interaction, e.g., to scroll through menu selections (via rotation of the control), to select menu selections (via depression of the control), etc.

Figure 13:
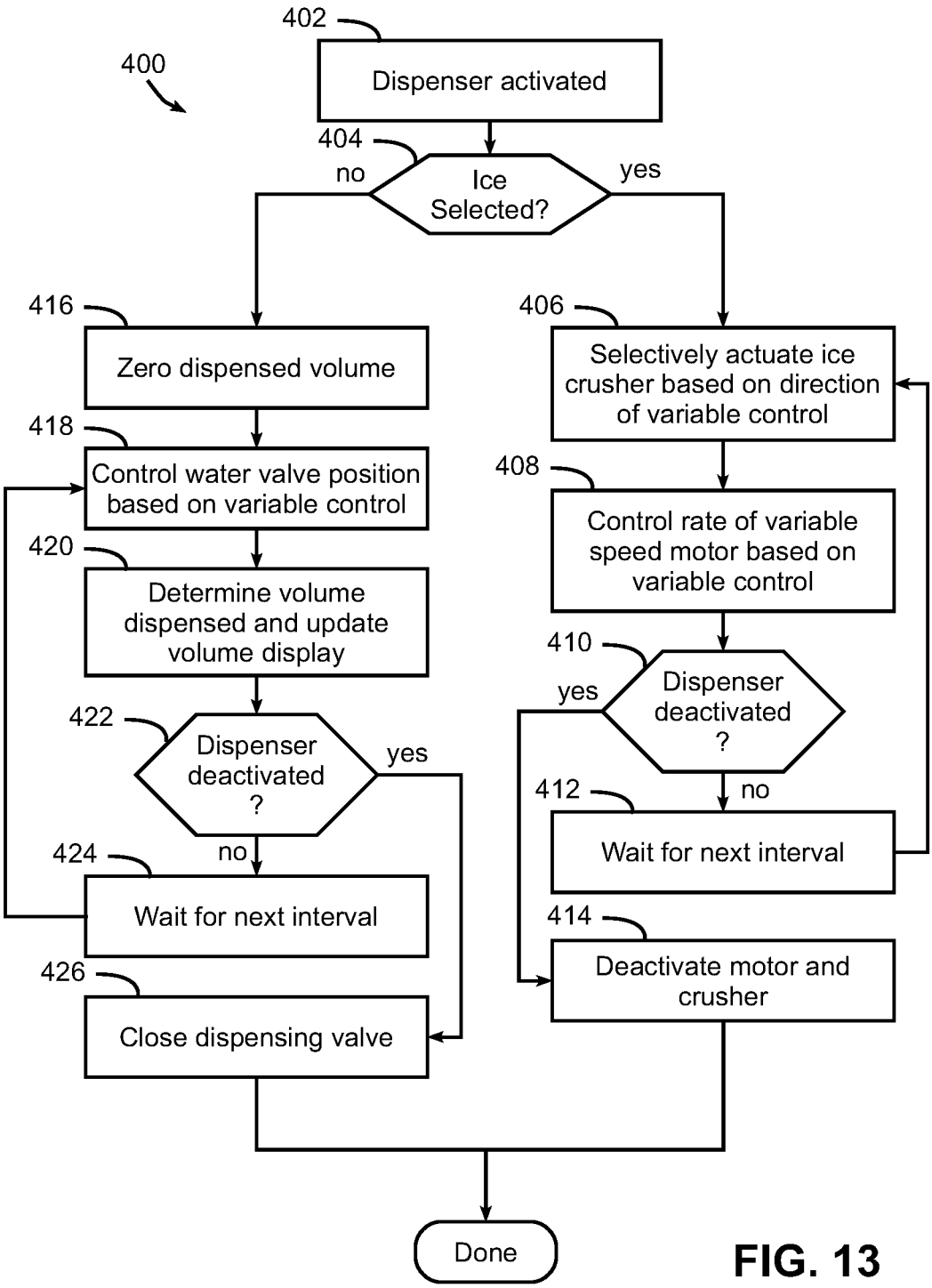
FIG. 13 is a flowchart illustrating an example sequence of operations for dispensing water and/or ice in the refrigerator of FIGS. 1-2.

Now turning to FIG. 13, this figure illustrates an example sequence of operations for a dispensing routine 400 suitable for implementation in a controller such as controller 40 of FIG. 2 to dispense using a variable control consistent with the invention. For the purposes of this example, it is assumed that a combined ice/water dispenser with crushing capability is being controlled. In response to activation of the dispenser, e.g., in response to movement of a variable control actuator, actuation of a secondary control, actuation of a separate mode or dispense switch, actuation of a container-actuated control, or container detection by a presence sensor (block 402), block 404 determines whether an ice dispensing mode has been selected. If so, control passes to block 406 to selectively actuate the ice crusher if crushed ice has been selected (e.g., based upon a mode selection switch, a secondary control or direction of movement of a variable control). Block 408 then activates the dispenser to dispense ice, with the rate of dispensing controlled by the variable control (e.g., by controlling the speed of an auger motor). Block 410 then determines if dispenser has been deactivated (e.g., based upon release of a variable control actuator, release of a secondary control, release of a separate mode or dispense switch, release of a container-actuated control, or lack of container detection by a presence sensor), and if not, control passes to block 412 to wait for a next polling interval, and then control returns to block 406 to continue dispensing. if, however, the dispenser has been deactivated, block 410 passes control to block 414 to deactivate the auger motor and the ice crusher, and routine 400 is complete.

Returning to block 404, if an ice dispensing mode is not selected (indicating water dispensing is desired), control passes to block 416 to zero a dispensed volume variable, and then to block 418 to control a position of a water dispensing valve based upon the position of the variable control. Block 420 then determines the volume dispensed during the current interval and displays the current volume dispensed on a refrigerator display (if so supported). Block 422 then determines if dispenser has been deactivated (e.g., based upon release of a variable control actuator, release of a secondary control, release of a separate mode or dispense switch, release of a container-actuated control, or lack of container detection by a presence sensor), and if not, control passes to block 424 to wait for a next polling interval, and then control returns to block 418 to continue dispensing. if, however, the dispenser has been deactivated, block 424 passes control to block 426 to close the water dispensing valve, and routine 400 is complete.

It will be appreciated that the various features and techniques disclosed herein may be used separately from one another or in various combinations, so the specific variable control examples illustrated in FIGS. 4-12 should not be considered as limiting. Other modifications will be apparent to those of ordinary skill in the art having the benefit of the instant disclosure. Therefore, the invention lies in the claims hereinafter appended.

What is claimed is:

1. A refrigerator, comprising:

a cabinet including at least one or more food storage compartments defined therein and at least one or more doors positioned to insulate the at least one or more food storage compartments from an exterior environment;

a variable water dispenser coupled to the cabinet and configured to dispense water at a variable water dispensing rate from a dispenser outlet; and a variable control disposed on an exterior surface of a door among the at least one or more doors and coupled to the variable water dispenser, the variable control including:

a rotary control actuator rotatable between a range of positions to vary the water dispensing rate of the variable water dispenser in response to rotation of the rotary control actuator, the range of positions including a home position at which the variable water dispenser is deactivated, and wherein rotation of the rotary control actuator away from the home position both activates the variable water dispenser to dispense water and increases the dispensing rate of the variable water dispenser; and a bias mechanism configured to bias the rotary control actuator to the home position, whereby the rotary control actuator returns to the home position when released by a user.

2. A refrigerator, comprising:

a cabinet including at least one or more food storage compartments defined therein and at least one or more doors positioned to insulate the at least one or more food storage compartments from an exterior environment;

a variable dispenser coupled to the cabinet and configured to dispense a fluid at a variable fluid dispensing rate from a dispenser outlet; and a variable control disposed on an exterior surface of the cabinet and coupled to the variable dispenser, the variable control including a rotary control actuator configured to vary the fluid dispensing rate of the variable dispenser in response to rotation of the rotary control actuator, the rotary control actuator rotatable between a range of positions, the range of positions including a home position at which the variable dispenser is deactivated, and wherein rotation of the rotary control actuator away from the home position both activates the variable dispenser to dispense fluid and increases the fluid dispensing rate of the variable dispenser.

3. The refrigerator of claim 2, wherein the exterior surface upon which the variable control is disposed is on a door of the cabinet.

4. The refrigerator of claim 2, wherein the rotary control actuator is rotatable about an axis of rotation that is generally perpendicular to the exterior surface of the cabinet.

5. The refrigerator of claim 4, wherein the variable control includes a stationary front surface, and wherein the rotary control actuator includes a generally cylindrical wheel with at least a portion thereof disposed between the stationary front surface and the exterior surface of the cabinet.

6. The refrigerator of claim 2, wherein the rotary control actuator is configured to rotate about an axis of rotation, and wherein the variable control further includes a secondary control responsive to an axial force applied to the variable control.

7. The refrigerator of claim 6, wherein the secondary control comprises a switch responsive to movement of the variable control along the axis of rotation.

8. The refrigerator of claim 6, wherein the secondary control comprises a touch-sensitive region of a surface of the variable control.

9. The refrigerator of claim 6, wherein the variable dispenser is configured to change a dispense mode in response to actuation of the secondary control.

10. The refrigerator of claim 9, wherein the variable dispenser is further configured to dispense ice, and wherein the variable dispenser is configured to switch between a fluid dispensing mode and an ice dispensing mode in response to actuation of the secondary control.

11. The refrigerator of claim 6, wherein the variable dispenser is configured to activate a fluid dispensing valve of the variable dispenser to dispense fluid in response to actuation of the secondary control, wherein the variable control controls the fluid dispensing rate of the variable dispenser when the secondary control is activated.

12. The refrigerator of claim 2, wherein the variable control further includes a bias mechanism that biases the rotary control actuator to the home position, whereby the rotary control actuator returns to the home position when released by a user.

13. The refrigerator of claim 2, further comprising a dispenser actuation control configured to activate a fluid dispensing valve of the variable dispenser to dispense fluid in response to actuation of the dispenser actuation control, wherein the variable control controls the fluid dispensing rate of the variable dispenser when the dispenser actuation control is activated.

14. The refrigerator of claim 13, wherein the dispenser actuation control comprises a container-activated control positioned below the dispenser outlet of the variable dispenser and configured to be activated by a container placed below an outlet of the variable dispenser.

15. The refrigerator of claim 2, wherein the variable dispenser comprises a water dispenser configured to dispense water from a dispenser outlet.

16. The refrigerator of claim 15, wherein the variable dispenser includes a vented water storage receptacle upstream of the dispenser outlet and configured to dispense water at a higher rate than a water supply rate from a water supply in upstream communication with the vented water storage receptacle.

17. A refrigerator, comprising:

a cabinet including at least one or more food storage compartments defined therein and at least one or more doors positioned to insulate the at least one or more food storage compartments from an exterior environment;

a variable dispenser coupled to the cabinet and configured to dispense a fluid at a variable fluid dispensing rate from a dispenser outlet; and a variable control disposed on an exterior surface of the cabinet and coupled to the variable dispenser, the variable control including a variable control actuator disposed above the dispenser outlet and configured to vary the fluid dispensing rate of the variable dispenser in response to movement of the variable control actuator, the variable control actuator movable between a range of positions, the range of positions including a home position at which the variable dispenser is deactivated, and wherein movement of the variable control actuator away from the home position both activates the variable dispenser to dispense fluid and increases the fluid dispensing rate of the variable dispenser.

18. The refrigerator of claim 17, wherein the variable control actuator comprises a rotary control actuator that is rotatable about an axis of rotation.

19. The refrigerator of claim 17, wherein the variable control actuator comprises a linear control actuator that is moveable along a generally linear axis.

20. The refrigerator of claim 17, wherein the variable control further includes a bias mechanism that biases the variable control actuator to the home position, whereby the variable control actuator returns to the home position when released by a user.

* * * * *